US011174125B2

(12) United States Patent
Kou et al.

(10) Patent No.: US 11,174,125 B2
(45) Date of Patent: Nov. 16, 2021

(54) OVERWINDING BUFFER DEVICE AND METHOD FOR VERTICAL HOISTING SYSTEM

(71) Applicant: TAIYUAN UNIVERSITY OF TECHNOLOGY, Taiyuan (CN)

(72) Inventors: Ziming Kou, Taiyuan (CN); Juan Wu, Taiyuan (CN); Jianwei Yang, Taiyuan (CN); Guijun Gao, Taiyuan (CN); Jing Zhang, Taiyuan (CN); Peng Zhang, Taiyuan (CN); Liangji Zhao, Taiyuan (CN)

(73) Assignee: TAIYUAN UNIVERSITY OF TECHNOLOGY, Taiyuan (CN)

( * ) Notice: Subject to any disclaimer, the term of this patent is extended or adjusted under 35 U.S.C. 154(b) by 453 days.

(21) Appl. No.: 16/324,895

(22) PCT Filed: Oct. 31, 2016

(86) PCT No.: PCT/CN2016/103942

§ 371 (c)(1),
(2) Date: Feb. 11, 2019

(87) PCT Pub. No.: WO2018/072228

PCT Pub. Date: Apr. 26, 2018

(65) Prior Publication Data

US 2021/0284500 A1 Sep. 16, 2021

(30) Foreign Application Priority Data

Oct. 17, 2016 (CN) ..... 201610905872.1

(51) Int. Cl.
*B66B 5/08* (2006.01)
*B66B 5/28* (2006.01)
(Continued)

(52) U.S. Cl.
CPC ..... *B66B 5/08* (2013.01); *B66B 5/16* (2013.01); *B66B 5/282* (2013.01); *B66B 17/04* (2013.01)

(58) Field of Classification Search
USPC ..... 187/349
See application file for complete search history.

(56) References Cited

U.S. PATENT DOCUMENTS 725,491 A 4/1903 Scott
4,635,907 A * 1/1987 Bialy ..... B66B 5/282 187/344

FOREIGN PATENT DOCUMENTS

CN 2570232 Y 9/2003
CN 101402438 A 4/2009
(Continued)

OTHER PUBLICATIONS

International Search Report in the international application No. PCT/CN2016/103942, dated Jun. 28, 2017.
(Continued)

*Primary Examiner* — Jeffrey Donels
(74) *Attorney, Agent, or Firm* — Syncoda LLC; Feng Ma

(57) ABSTRACT

An overwinding buffer device and method are employed for a vertical hoisting system including a derrick and a hoisting container. A hydraulic buffer device is disposed on the derrick, the hydraulic buffer device including at least one buffering hydraulic cylinder and buffering pressure rollers disposed corresponding to the buffering hydraulic cylinders; the buffering hydraulic cylinders are disposed on the derrick; piston rods of the buffering hydraulic cylinders are disposed horizontally and outer ends of the piston rods face towards the hoisting container; the buffering pressure rollers are horizontally fixed on an outer side wall of the hoisting container and arced surfaces of the buffering pressure rollers
(Continued)

face towards the piston rods of the buffering hydraulic cylinders.

18 Claims, 7 Drawing Sheets

(51) Int. Cl.
*B66B 17/04* (2006.01)
*B66B 5/16* (2006.01)

(56) References Cited

FOREIGN PATENT DOCUMENTS

| | | | |
|---|---|---|---|
| CN | 102674107 | A | 9/2012 |
| CN | 202657793 | U | 1/2013 |
| CN | 203582222 | U | 5/2014 |
| CN | 104016206 | A | 9/2014 |
| CN | 204342220 | U | 5/2015 |
| CN | 204454212 | U | 7/2015 |
| CN | 205367385 | U | 7/2016 |
| EP | 1312575 | A1 | 5/2003 |
| EP | 1312575 | B1 | 3/2008 |
| GB | 869853 | A | 6/1961 |
| JP | 2002145545 | A | 5/2002 |
| JP | 2003182944 | A | 7/2003 |
| WO | 2014194373 | A1 | 12/2014 |

OTHER PUBLICATIONS

English Translation of the Written Opinion of the International Search Authority in the international application No. PCT/CN2016/103942, dated Jun. 28, 2017.
Research on Hydraulic Steel-belt Overwinding Buffer Device, mailed on Sep. 30, 2012.

* cited by examiner

OVERWINDING BUFFER DEVICE AND METHOD FOR VERTICAL HOISTING SYSTEM

CROSS-REFERENCE TO RELATED APPLICATION

The present application claims benefit of Chinese Patent Application 201610905872.1, filed on Oct. 17, 2016, the contents of which are hereby incorporated by reference in its entirety.

TECHNICAL FIELD

The disclosure relates to the technical field of weight lifting, and particularly to an over-winding buffer for a vertical lifting system and associated method.

BACKGROUND

A mine vertical well lifting system, compared with the other vertical well lifting system, has the following characteristics: large transport volume, high operation speed, and great hazards in case of continuous use and occurrence of over-winding. Thus, it is necessary to arrange a corresponding over-winding buffer for the mine vertical well lifting system. At present, friction energy absorption type over-winding buffers and steel belt plastic deformation energy absorption type over-winding buffers are generally accepted and adopted in vertical mine well lifting systems. The friction coefficient of the friction energy absorption type over-winding buffer may be changed when the environment (for example, temperature, humidity and medium) is changed, and the using effect of the over-winding buffer is restricted. Braking performance of a steel belt plastic deformation energy absorption type over-winding buffer is influenced by steel material of the steel belt. The steel belt is prolonged and thinned during braking, and thus the steel belt may be thinned and easily broken upon a high-speed impact. A final load bearing mechanism of its backstop device is also the steel belt, and if the steel belt is broken, a cage may fall down after reaching a highest point, so that accidents of breakage of a steel wire and cage falling may happen.

According to utility model patent CN2570232 named "backstop buffer for vertical lifting system, with plastic deformation within over-winding distance", this utility model belongs to a steel belt plastic deformation energy absorption type over-winding buffer. The device is provided with two fixed hollow sleeve posts. Hollow sliding posts capable of sliding are arranged in the sleeve posts, and the two sliding posts are transversely carried by a beam. A steel belt capable of generating plastic deformation passes through interiors of the hollow sleeve posts and sliding posts, and its two ends are mounted at and connected to the sleeve posts. A set of pressure rollers are mounted on each sliding post, and when the sliding posts move, the pressure rollers are driven to force the steel belt to generate S-shaped plastic deformation to generate a buffering braking force. The device is a buffer mounted within an over-winding distance in use, absorbs kinetic energy of a lifting container to enable a braking function by virtue of plastic deformation of a metal material and is capable of preventing the lifting container from reversely sliding downwards. However, after the device is used, a recovery process of the buffer is very complex and high in time consumption.

According to patent application CN102674107A named after "over-winding buffer for mine vertical well lifting system", a steel belt buffering part, a hydraulic buffering part and a recovery part thereof are arranged on a derrick of the disclosure patent, and are sequentially hinged to two ends of front and rear beams respectively, the beam of the hydraulic buffering part drives a hinged buffering oil cylinder to move together, pressure in the buffering oil cylinder is increased and reaches overflow pressure set by a connected hydraulic pump station system, and then overflow is started to absorb energy for primary energy absorption buffering. In addition, a steel belt in the steel belt buffering part is adopted to generate plastic deformation for secondary energy absorption buffering. In such an energy absorption mode, a primary energy absorption part is the hydraulic buffering part, so that the steel belt in the steel belt buffering part is deformed and stressed less, and is unlikely to be broken. Even if the condition of accidental breakage occurs, the hydraulic buffering part may still stop the lifting container. Therefore, reliability of the over-winding buffer is effectively ensured. However, the disclosure patent adopts a mechanism combining steel belt buffering and hydraulic buffering, so that a mechanical system is more complex, and production cost is increased by system components. Moreover, a hydraulic system is too complex, and there exist lots of problems to be improved.

Therefore, slow recovery, complex structure and high cost of a buffer are problems urgent to be solved.

SUMMARY

In view of this, embodiments of the disclosure are expected to provide an over-winding buffer for a vertical lifting system and associated method, which are safe, reliable, fast in recovery, simple in structure and low in cost.

In order to achieve the purpose, the technical solutions of the disclosure are implemented as follows.

The embodiments of the disclosure provide an over-winding buffer for a vertical lifting system. The vertical lifting system includes a derrick and a lifting container. The derrick is provided with a hydraulic buffer which comprises one or more buffering hydraulic cylinders and buffering pressure rollers corresponding to the buffering hydraulic cylinders.

Each of the buffering hydraulic cylinders is mounted on the derrick, and has a piston rod which is horizontally arranged. An outer end of the piston rod is oriented towards the lifting container. Each of the buffering pressure rollers is horizontally fixed on an outer sidewall of the lifting container, and has an arc surface which is oriented towards the piston rod of the corresponding buffering hydraulic cylinder.

In an embodiment, the one or more buffering hydraulic cylinders may be uniformly arranged on the derrick from bottom to top, and an outer end face of the piston rod of each of the buffering hydraulic cylinders may be aligned in an initial state.

In an embodiment, the outer end faces of the piston rods of the buffering hydraulic cylinders may be provided with replaceable wear-resistant materials.

In an embodiment, the replaceable wear-resistant materials may be wear-resistant steel belts. One end of the wear-resistant steel belt may be fixed on the outer end face of the piston rod of a upper buffering hydraulic cylinder of two buffering hydraulic cylinders which are adjacent in a vertical direction, another end of the wear-resistant steel belt may be fixed on the outer end face of a lower buffering hydraulic cylinder of the two buffering hydraulic cylinders.

In an embodiment, the derrick includes four support posts, each of the four support posts may be provided with the buffering hydraulic cylinders. The piston rod of each of the buffering hydraulic cylinders may be oriented towards the outer sidewall of the lifting container.

In an embodiment, the device is further provided with upright posts and beams. The upright posts are fixed on the derrick. Each of the beams may slide up and down on the upright posts; and each of the beams is provided with support claws for supporting the lifting container.

In an embodiment, the device is further provided with a metal material plastic deformation buffer, and the metal material plastic deformation buffer includes buffering metal belts and deformation members. Each of the buffering metal belts may be fixed on a respective one of the upright posts. Each of the deformation members may be fixed on a respective one of the beams. When the lifting container inertially ascends and drives the beams to ascend, each of the buffering metal belts may be plastically deformed by a respective one of the deformation members.

In an embodiment, the deformation members are deformation pressure roller sets arranged on the beams. Each deformation pressure roller set includes three deformation pressure rollers arranged in the vertical direction. Each buffering metal belt has an end fixed at one end of the upright post, and another end fixed at another end of the upright post after passing through the three deformation pressure rollers. The buffering metal belt passing between the three deformation pressure rollers may present an S shape.

The embodiments of the disclosure further provide an over-winding buffering method for a vertical lifting system, which includes that:

when a lifting container continues to ascend due to inertia after being elevated to a predetermined position, lifting container squeezes piston rods of buffering hydraulic cylinders arranged on a derrick of the vertical lifting system in a horizontal direction; and the squeezed piston rods of the buffering hydraulic cylinders are recovered to initial positions or be pressed against an outer sidewall of the lifting container.

In an embodiment, the operation that the squeezed piston rods of the buffering hydraulic cylinders are recovered to the initial positions or be pressed against the outer sidewall of the lifting container includes that:

when the lifting container continues to ascend due to inertia and when buffering pressure rollers fixed on the outer sidewall of the lifting container leave outer end faces of the piston rods of the buffering hydraulic cylinders at current positions, the piston rods of the buffering hydraulic cylinders at the current positions are recovered to the initial positions or be pressed against the outer sidewall of the lifting container.

In an embodiment, the operation that the squeezed piston rods of the buffering hydraulic cylinders are recovered to the initial positions or be pressed against the outer sidewall of the lifting container includes that:

when the lifting container continues to ascend due to inertia and when the buffering pressure rollers fixed on the outer sidewall of the lifting container squeeze the piston rods of the buffering hydraulic cylinders at the current positions, the piston rods of the buffering hydraulic cylinders below the current positions are recovered to the initial positions.

In an embodiment, the method further includes that:

hydraulic oil at a preset pressure is distributed into a hydraulic pipeline connecting the buffering hydraulic cylinders.

According to the over-winding buffer and method for the vertical lifting system provided by the embodiments of the disclosure, the vertical lifting system includes the derrick and the lifting container. The hydraulic buffer is arranged on the derrick. The hydraulic buffer includes the at least one buffering hydraulic cylinder and the buffering pressure rollers arranged correspondingly to the buffering hydraulic cylinders. The buffering hydraulic cylinders are mounted on the derrick, the piston rods of the buffering hydraulic cylinders are horizontally arranged, and the outer ends of the piston rods are oriented towards the lifting container. The buffering pressure rollers are horizontally fixed on the outer sidewall of the lifting container, and the arc surfaces are oriented towards the piston rods of the buffering hydraulic cylinders. Thus it can be seen that, according to the over-winding buffer and method for the vertical lifting system in the embodiments of the disclosure, friction energy absorption type over-winding buffering is implemented through the hydraulic cylinders. In a buffering process, a braking force is gradually strengthened, a braking process of the hydraulic cylinders is convenient to control, the braking force is convenient to regulate, the braking force is strengthened by increasing pressure of the hydraulic pipeline, and the braking force may further be strengthened by increasing a number of the hydraulic cylinders. Therefore, safety, reliability, fast recovery, simple structure and low cost are achieved.

DETAILED DESCRIPTION

Figure 1:
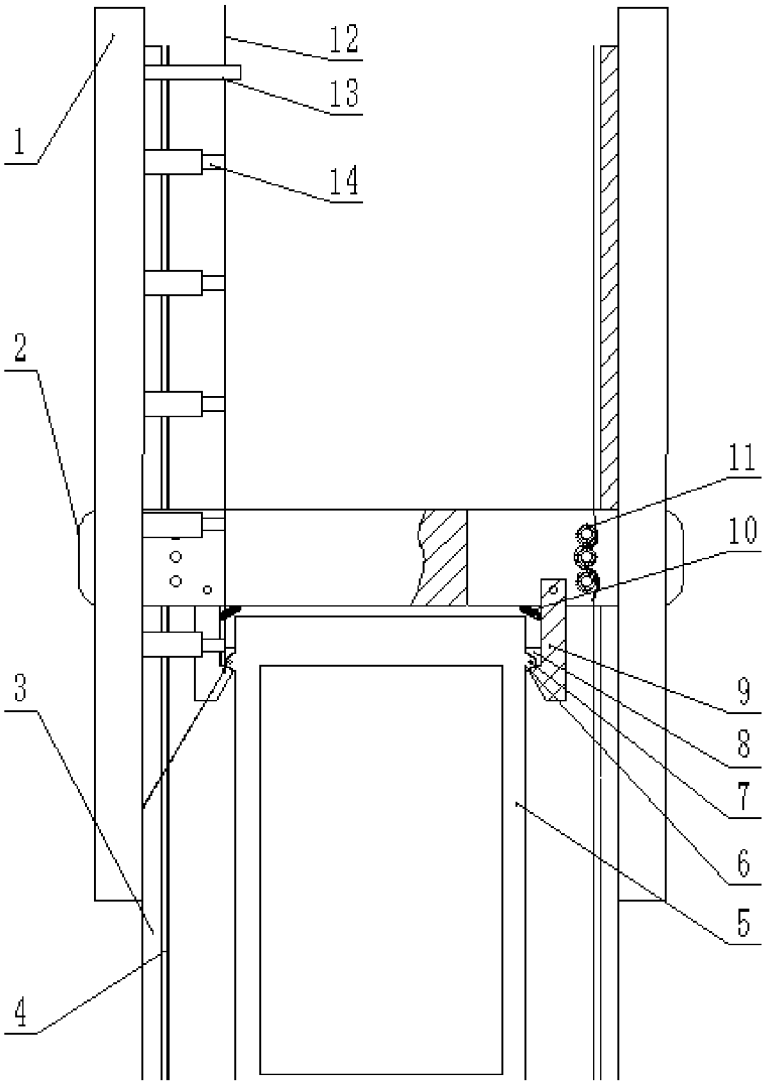
FIG. 1 is a front projection diagram of an over-winding buffer for a vertical lifting system according to an embodiment of the disclosure.

The embodiments of the disclosure provide an over-winding buffer for a vertical lifting system. The vertical lifting system includes a derrick and a lifting container. A hydraulic buffer is arranged on the derrick, and the hydraulic buffer includes at least one buffering hydraulic cylinder and buffering pressure rollers arranged correspondingly to the buffering hydraulic cylinders. The buffering hydraulic cylinders are mounted on the derrick. Piston rods of the buffering hydraulic cylinders are horizontally arranged, and outer ends of the piston rods are oriented towards the lifting container. The buffering pressure rollers are horizontally fixed on an outer sidewall of the lifting container, and arc surfaces of the buffering pressure rollers are oriented towards the piston rods of the buffering hydraulic cylinders.

Here, the lifting container is a general term of a skip, a cage, a bucket and the like, and is a container for loading minerals, waste rocks and gangues and transferring people and other materials. The lifting container may vertically ascend and descend up and down in a space enclosed by four support posts of the derrick under the action of the vertical lifting system.

In the embodiments of the disclosure, the piston rods of the buffering hydraulic cylinders are at initial positions capable of making their outer end faces right pressed against the outer sidewall of the lifting container. The buffering pressure rollers are arranged on the outer sidewall of the lifting container, and protrude from the outer sidewall of the lifting container. Therefore, in an ascending process of the lifting container, the buffering pressure rollers may squeeze the piston rods of the buffering hydraulic cylinders, and the piston rods retract until ascending kinetic energy of the lifting container is reduced to be incapable of squeezing the piston rods of the buffering hydraulic cylinders to retract.

Specifically, the arc surfaces of the buffering pressure rollers are oriented towards the piston rods of the buffering hydraulic cylinders to obtain a component force in a horizontal direction originated from a force applied by the lifting container in a vertical direction, thereby achieving a squeezing action on the piston rods of the buffering hydraulic cylinders. Otherwise, if there is only the force in the vertical direction, a shearing force or a bending moment may be applied to the piston rods of the buffering hydraulic cylinders to damage the piston rods.

A working principle of the hydraulic buffer is that: when the buffering pressure rollers squeeze the piston rods of the buffering hydraulic cylinders, pressure of the buffering hydraulic cylinders is required to be overcome, so that the upward kinetic energy of the lifting container is consumed. Meanwhile, besides preventing upward movement of the lifting container, the pressure of the buffering hydraulic cylinders may also overcome potential energy of the lifting container and prevent downward movement of the lifting container, that is, the buffering hydraulic cylinders have a braking action on movement of the lifting container.

Furthermore, each buffering hydraulic cylinder is uniformly arranged on the derrick from bottom to top, and an outer end face of the piston rod of each buffering hydraulic cylinder is aligned in an initial state. In such a manner, when the lifting container keeps ascending, the piston rod of each buffering hydraulic cylinder may be sequentially squeezed from bottom to top, so that the hydraulic buffer may implement multi-point braking for many times, and a good braking effect may be ensured.

Furthermore, besides the manner that the lifting container ascends to squeeze the piston rod of each buffering hydraulic cylinder to brake the lifting container by the buffering hydraulic cylinders, the piston rod of each buffering hydraulic cylinder may also actively extend to be pressed against the outer sidewall of the lifting container. In an ascending or descending process of the lifting container, an effect of frictional braking between the buffering hydraulic cylinders and the lifting container is achieved.

Specifically, the buffering hydraulic cylinders are pressed against the outer sidewall of the lifting container through their piston rods to achieve the braking effect through two implementation solutions.

A first solution: after the buffering pressure roller leaves a position of the piston rod of the lowest buffering hydraulic cylinder, the piston rod of the lowest buffering hydraulic cylinder may extend outwards until being pressed against the outer sidewall of the lifting container or returning to an initial position. The piston rods of the buffering hydraulic cylinders may all extend outwards after being freed from squeezing of the buffering pressure rollers until being pressed against the outer sidewall of the hosting container or returning to initial positions. In such a manner, when the lifting container moves upwards or downwards, the piston rods of the buffering hydraulic cylinders may generate friction with the outer sidewall of the lifting container to prevent movement of the lifting container. A magnitude of a frictional force is related to pressure of the buffering hydraulic cylinder.

Specifically, a principle that the piston rod of the buffering hydraulic cylinder may extend outwards is as follows: hydraulic oil at a preset pressure is arranged in a hydraulic pipeline connecting the buffering hydraulic cylinder, the preset pressure being sufficient for the piston rod to extend outwards to a predetermined position and overcome certain external pressure, and when upward movement kinetic energy of the lifting container is sufficient, the buffering pressure roller on the outer sidewall of the lifting container may overcome the preset pressure, the hydraulic oil flows out of the buffering hydraulic cylinder, and the piston rod of the buffering hydraulic cylinder retracts; and when the buffering pressure roller leaves the position of the piston rod of the buffering hydraulic cylinder, the hydraulic oil at the preset pressure may flow back to the buffering hydraulic cylinder, and the piston rod of the buffering hydraulic cylinder may extend outwards again until being pressed against the outer sidewall of the lifting container or returning to the initial position.

More specifically, overflow valves may be arranged in the hydraulic pipe connecting the buffering hydraulic cylinders, and when the upward movement kinetic energy of the lifting container is sufficient, the hydraulic oil flows back to an oil tank from the overflow valves. A hydraulic pump and an energy accumulator are arranged in the hydraulic pipeline, so that the preset pressure in the hydraulic pipeline may be kept, and the hydraulic oil may smoothly flow back to the buffering hydraulic cylinders.

A second solution: when the lifting container continues to ascend due to inertia and arrive the position corresponding to the second lowest buffering hydraulic cylinder above the lowest buffering hydraulic cylinder, the buffering pressure roller may squeeze the piston rod of the second lowest buffering hydraulic cylinder to retract; after the piston rod of the second lowest buffering hydraulic cylinder retracts, the piston rod of the lowest buffering hydraulic cylinder may extend outwards until being pressed against the outer sidewall of the lifting container or returning to the initial position; the piston rods of all the buffering hydraulic cylinders below the current position of the buffering pressure roller may extend outwards until being pressed against the outer sidewall of the lifting container or returning to the initial positions after the piston rods of the buffering hydraulic cylinders above retract.

Specifically, a principle that the piston rod of the buffering hydraulic cylinder may extend outwards is as follows: after the piston rod of the second lowest buffering hydraulic cylinder is squeezed by the buffering pressure roller; the hydraulic oil flows out of the second lowest buffering hydraulic cylinder; and since the hydraulic oil at the preset pressure is arranged in the whole hydraulic pipeline and the piston rod of the lowest buffering hydraulic cylinder is in a free state, that is, pressure in the lowest buffering hydraulic cylinder is lowest; the hydraulic oil flowing out of the second lowest buffering hydraulic cylinder drives the hydraulic oil in the pipeline to flow into the lowest buffering hydraulic cylinder.

Of course, the two solutions may be superposed, so that the braking action achieved by the buffering hydraulic cylinders is stronger.

Furthermore, the outer end faces of the piston rods of the buffering hydraulic cylinders may be provided with replaceable wear-resistant materials, so that wear to the piston rods of the buffering hydraulic cylinders may be avoided.

Specifically, the replaceable wear-resistant materials may be wear-resistant steel belts, the wear-resistant steel belts being readily available and high in performance; and two ends of each wear-resistant steel belt are fixed on the outer end faces of the piston rods of two buffering hydraulic cylinders which are adjacent in the vertical direction. Therefore, wear to the piston rods of the buffering hydraulic cylinders may be reduced on one hand, and on the other hand, the buffering pressure rollers may smoothly reach the positions at which the piston rods of the buffering hydraulic cylinders are squeezed. There may also be a whole wear-resistant steel belt connected with each buffering hydraulic cylinder respectively.

More specifically, the wear-resistant steel belt may adopt a steel belt with high surface hardness. For example, a steel belt made from high-carbon steel may be adopted, for example, 65 #steel and 65 Mn steel, and a surface treatment method may also be adopted for a steel belt made from low-carbon steel, for example, surface carburization, which will not be specifically described.

Furthermore, the derrick includes four support posts, the buffering hydraulic cylinders are arranged on all of the four support posts, and all of the piston rods of the buffering hydraulic cylinders are oriented towards the outer sidewall of the lifting container. Therefore, a stronger braking force may be provided, the braking force is symmetrically distributed, and stabilization of the whole vertical lifting system is facilitated.

For preventing the whole vertical lifting system from being damaged by inertial ascending of the lifting container reaching the predetermined position, the device is further provided with upright posts and beams, the upright posts are fixed on the derrick, and the beams may slide up and down on the upright posts. Therefore, when the lifting container continues to ascend due to inertia to collide with the beams after reaching the predetermined position, the characteristic of free upward and downward sliding of the beams counteracts with an impact force of the lifting container.

Furthermore, for avoiding repeated collision between the lifting container and the beams in the ascending process, the beams are provided with support claws supporting the lifting container. The lifting container may be supported by the support claws of the beams after reaching the predetermined position, then the lifting container is fixed together with the beams, and inertial ascending of the lifting container is converted into free sliding of the beams on the upright posts, so that impact and damage of inertial ascending of the lifting container to the whole vertical lifting system are greatly reduced.

Specifically, upper ends of the support claws are hinged to the beams, conical surfaces are arranged on inner sides of lower ends of the support claws, and the conical surfaces may rotate the lower ends of the support claws outwards, namely rotating them towards a direction far away from the lifting container, when the lifting container inertially ascends to collide with the support posts; and protruding support claw beams are arranged on the outer sidewall of the lifting container, the support claws are further provided with resetting springs capable of resetting the outwards rotating support claws, and after the support claw beams move across the conical surfaces during ascending, the support claws are reset under the action of the resetting springs, and the support claws support the support claw beams, namely supporting the lifting container, so that the lifting container and the beams move integrally to avoid repeated collision.

For further enhancing a buffering effect and improving reliability, the device is further provided with a metal material plastic deformation buffer, and the metal material plastic deformation buffer includes buffering metal belts and deformation members; the buffering metal belts are fixed on the upright posts, and the deformation members are fixed on the beams; and when the lifting container inertially ascends and drives the beams to ascend, the deformation members plastically deform the buffering metal belts.

Furthermore, a material for the buffering metal belts may be steel, and steel is readily available, and has high comprehensive performance, particularly relatively high plastic deformation capability and tensile strength. More specifically, ordinary low-carbon steel, preferably steel with high plasticity and certain tensile strength, may be adopted, for example, Q235A.

Specifically, the deformation members are deformation pressure roller sets arranged on the beams. Each deformation pressure roller set includes three deformation pressure rollers arranged in the vertical direction. One end of each buffering metal belt is fixed at one end of the corresponding upright post, the other end is fixed at the other end of the upright post after passing through the corresponding three deformation pressure rollers. A shape of the buffering metal belt between the three deformation pressure rollers is an S shape. In such a manner, when the beam moves up and down, the three deformation pressure rollers may plastically deform the buffering metal belt. Since overcoming plastic deformation requires a lot of energy to be consumed, the upward kinetic energy of the lifting container is consumed.

Furthermore, thicknesses of the buffering metal belts are gradually increased from bottom to top. Therefore, if the lifting container ascends to a higher position, more kinetic energy is required to be consumed to overcome the plastic deformation of the buffering metal belts, and thus a better braking effect may be achieved.

For making the characteristics and technical contents of the embodiments of the disclosure understood in more detail, the disclosure will further be elaborated below in combination with the drawings and specific application embodiments. The appended drawings are adopted only for descriptions as a reference and not intended not to limit the embodiments of the disclosure.

Figure 2:
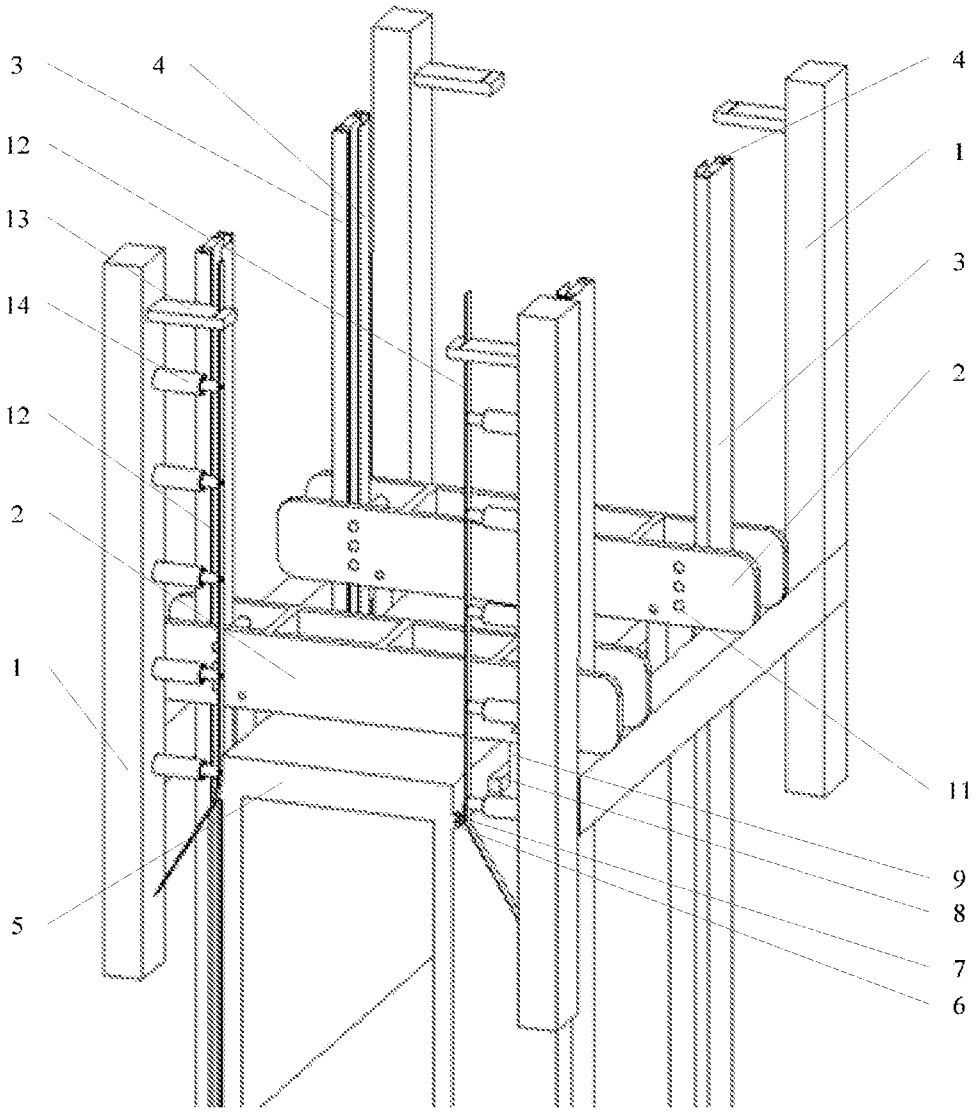
FIG. 2 is a schematic diagram of an axonometric drawing of an over-winding buffer for a vertical lifting system according to an embodiment of the disclosure.

FIG. 1 is a front projection diagram of an over-winding buffer for a vertical lifting system according to an embodiment of the disclosure. FIG. 2 is a schematic diagram of an axonometric drawing of an over-winding buffer for a vertical lifting system according to an embodiment of the disclosure. As shown in FIGS. 1 and 2, an over-winding buffer for a vertical lifting system includes a hydraulic buffer and a metal material plastic deformation buffer. The two sets of buffers co-act to achieve a better buffering effect, safety and reliability.

The hydraulic buffer assisted with the metal material plastic deformation buffer and the metal material plastic deformation buffer will be introduced below respectively.

The hydraulic buffer includes a derrick 1. The derrick 1 includes four support posts. Buffering hydraulic cylinders 14 are arranged on all of the four support posts, five buffering hydraulic cylinders 14 are arranged on each support post, and the five buffering hydraulic cylinders 14 are arranged on the support post along a vertical direction at the same spacing.

An outer end face of a piston rod arranged on each buffering hydraulic cylinder is provided with a wear-resistant steel belt 12. For convenient the assembly, the buffering hydraulic cylinders on the same support post of the derrick 1 use a whole wear-resistant steel belt 12, and the wear-resistant steel belt 12 is fixed with the piston rod of each buffering hydraulic cylinder respectively.

As shown in FIGS. 1 and 2, a lifting container 5 is arranged in a space enclosed by the four support posts of the derrick 1, and the lifting container 5 may vertically ascend and descend up and down in the space enclosed by the four support posts of the derrick 1 under the action of the vertical lifting system. For achieving an action of the hydraulic buffer, buffering pressure rollers 7 corresponding to the buffering hydraulic cylinders 14 are arranged on an outer sidewall of the lifting container 5, the buffering pressure rollers 7 are horizontally placed, and arc surfaces are oriented towards the buffering hydraulic cylinders 14. Therefore, the buffering pressure rollers 7 may convert ascending kinetic energy into squeezing to piston rods of the buffering hydraulic cylinders 14 in a horizontal direction by virtue of the arc surfaces.

Since the surfaces of the buffering pressure rollers 7 have relatively serious friction, and are easy to damage, the buffering pressure rollers 7 are designed to be detachable. Correspondingly, the lifting container 5 is provided with pressure roller support lugs 6, and the buffering pressure rollers 7 are detachably assembled in the pressure roller support lugs 6.

Specifically, the pressure roller support lugs 6 are provided with mounting holes matched with the buffering pressure rollers 7, and one end of each buffering pressure roller 7 is inserted into the corresponding mounting hole, then is fixed by adopting another auxiliary detachable fixing method, and for example, may be fixed by a fastening screw (the auxiliary fixing method is not shown in the figures).

The hydraulic buffer is further provided with two beams 2 and four upright posts 3, the upright posts 3 are fixed on the derrick, and the beams 2 may slide up and down on the upright posts. Therefore, when continuing an inertial ascending after reaching a predetermined position, the lifting container may collide with the beams 2, and the characteristic of free upward and downward sliding of the beams 2 counteracts with an impact force of the lifting container 5.

The beams 2 are all provided with support claws 9 supporting the lifting container 5, and meanwhile, support claw beams 8 corresponding to the support claws 9 are arranged on the outer sidewall of the lifting container 5, so that the lifting container 5 may be supported by the support claws 9 after reaching the predetermined position. In addition, for avoiding interference between the buffering hydraulic cylinders 14 and the buffering pressure rollers 7, positions of the support claws 9 and the support claw beams 8 are required to avoid positions of the buffering hydraulic cylinders 14 and the buffering pressure rollers 7. For example, the support claw beams 8 are arranged in middle of an upper end of the outer sidewall of the lifting container 5, and the buffering pressure rollers 7 are arranged on two sides of the upper end of the outer sidewall of the lifting container 5.

Specifically, the support claws 9 are hinged to the beams 2, conical surfaces are arranged on inner sides of lower ends, and resetting springs 10 are arranged. When the lifting container 5 collides with the support claws 9 in an ascending process, the support claws 9 rotate outwards under an action of the conical surfaces, and after the support claw beams 8 on the outer sidewall of the lifting container 5 move across the conical surfaces, the support claws 9 are reset under an action of the resetting springs 10 to support the lifting container 5, so that the lifting container 5 and the beams 2 move integrally.

An upper bracket 13 is arranged at an upper end of the derrick 1, slots accommodating the wear-resistant steel belts 12 are formed in the upper bracket 13, and upper ends of the wear-resistant steel belts 12 are arranged in the slots in a manner of passing through the slots, so that positions of the upper ends of the wear-resistant steel belts 12 are limited.

The metal material plastic deformation buffer includes buffering metal belts 4 and deformation members.

Figure 3:
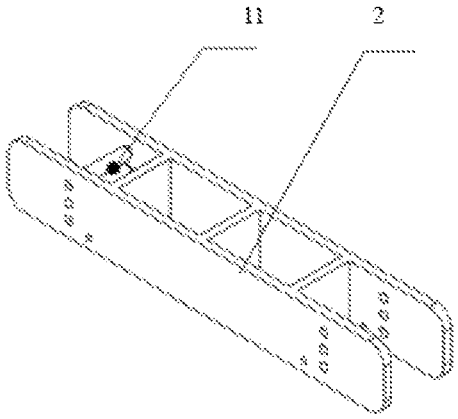
FIG. 3 is a schematic diagram of a beam in an over-winding buffer for a vertical lifting system according to an embodiment of the disclosure.

Specifically, as shown in FIG. 3, the beams 2 are all provided with the deformation members, the deformation members are deformation pressure roller sets 11 arranged on the beams 2, and each deformation pressure roller set 2 includes three deformation pressure rollers arranged in the vertical direction; the four upright posts are all provided with the buffering metal belts 4, one end of each buffering metal belt 4 is fixed at one end of the corresponding upright post 3, the other end is fixed at the other end of the upright post 3 after passing through the corresponding three deformation pressure rollers, and a shape of the buffering metal belt 4 between the three deformation pressure rollers is an S shape. In such a manner, when the beam 2 moves up and down, the three deformation pressure rollers may plastically deform the buffering metal belt 4. Since overcoming plastic deformation requires a lot of energy to be consumed, upward kinetic energy of the lifting container 5 is consumed.

Specifically, a material for the buffering metal belts 4 may be low-carbon steel.

Specifically, thicknesses of the buffering metal belts 4 are gradually increased from bottom to top, that is, special manufacturing is required. Therefore, if the lifting container 5 ascends to a higher position, more kinetic energy is required to be consumed to overcome plastic deformation of the buffering metal belts 4, and a better braking effect may be achieved.

Figure 5:
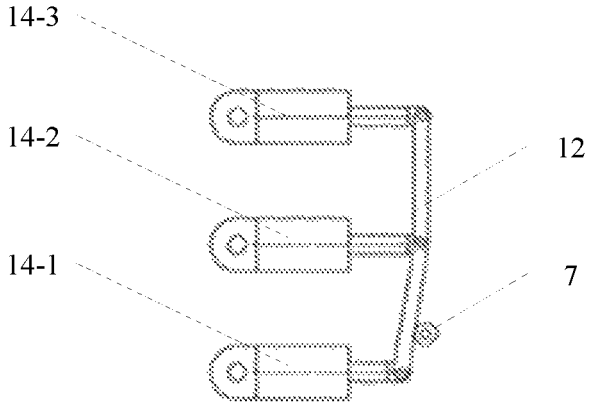
FIG. 5 is a first action diagram of buffering hydraulic cylinders in an over-winding buffer for a vertical lifting system according to an embodiment of the disclosure.
Figure 6:
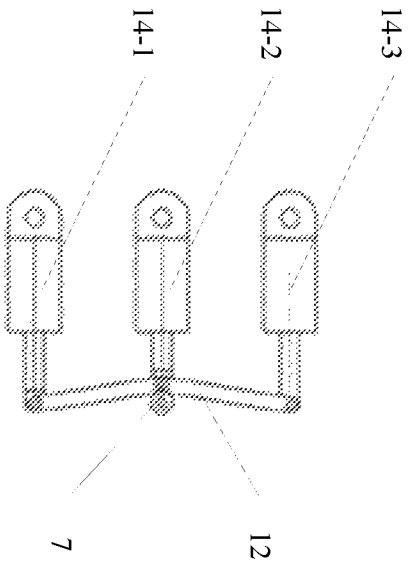
FIG. 6 is a second action diagram of buffering hydraulic cylinders in an over-winding buffer for a vertical lifting system according to an embodiment of the disclosure.

For making a braking principle of the buffering hydraulic cylinders in the over-winding buffer for the vertical lifting system in the embodiment of the disclosure understood in more detail, further descriptions will be made below in combination with FIGS. 4, 5 and 6.

Figure 4:
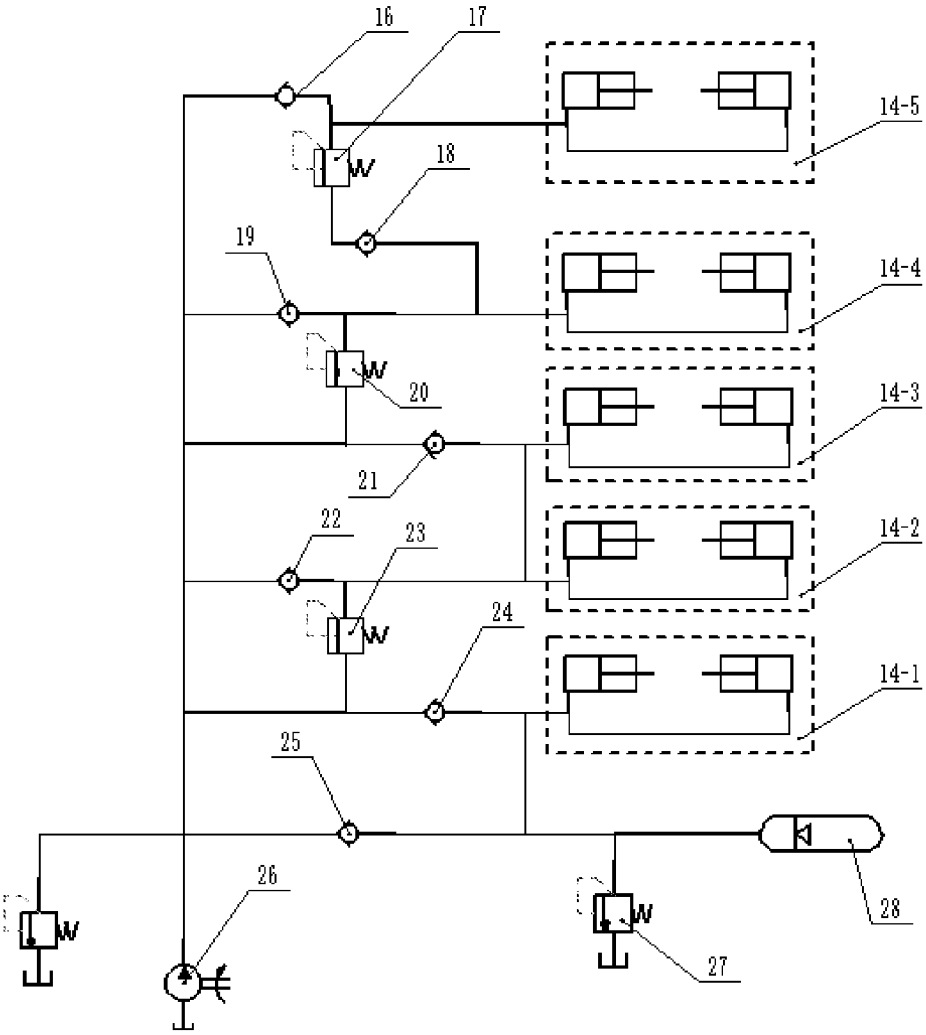
FIG. 4 is a schematic diagram of a hydraulic system in an over-winding buffer for a vertical lifting system according to an embodiment of the disclosure.

FIG. 4 is a schematic diagram of a hydraulic system in an over-winding buffer for a vertical lifting system according to an embodiment of the disclosure. FIG. 5 is a first action diagram of buffering hydraulic cylinders in an over-winding buffer for a vertical lifting system according to an embodiment of the disclosure. FIG. 6 is a second action diagram of buffering hydraulic cylinders in an over-winding buffer for a vertical lifting system according to an embodiment of the disclosure. As shown in FIGS. 4, 5 and 6, a hydraulic cylinder in the over-winding buffer for the vertical lifting system in the embodiment of the disclosure includes buffering hydraulic cylinders 14-1, 14-2, 14-3, 14-4 and 14-5, backstop valves 16, 18, 19, 21, 22, 24 and 25, overflow valves 17, 20, 23 and 27, a hydraulic pump 26 and an energy accumulator 28. Correspondingly, an action process of the hydraulic system of the embodiment of the disclosure is as follows.

When a lifting container 5 continues to ascend due to inertia after being elevated to a predetermined position, its buffering pressure rollers 7 may squeeze a piston rod of the buffering hydraulic cylinder 14-1 at first, and because a squeezing force of the buffering pressure rollers 7 is higher than the preset pressure of the overflow valve 27, hydraulic oil of the buffering hydraulic cylinder 14-1 flows back to an oil tank through the overflow valve 27, and the piston rod of the buffering hydraulic cylinder 14-1 retracts.

When the lifting container 5 continues to ascend, the buffering pressure rollers 7 squeeze a piston rod of the buffering hydraulic cylinder 14-1, and hydraulic oil of the buffering hydraulic cylinder 14-2 is forced to flow out. Because the buffering hydraulic cylinder 14-3 above is filled with hydraulic oil and the backstop valves 21 and 22 act for blocking, the hydraulic oil flowing out of the buffering hydraulic cylinder 14-2 may not move upwards, may also not move leftwards, and may only move downwards through the overflow valve 23. After downward movement, the piston rod of the buffering hydraulic cylinder 14-1 is in a free state, and pressure in the buffering hydraulic cylinder 14-1 in the whole pipeline is lowest, so that the hydraulic oil flowing out of the buffering hydraulic cylinder 14-2 drives the hydraulic oil in the pipeline to flow into the buffering hydraulic cylinder 14-1 at first, and the piston rod of the buffering hydraulic cylinder 14-1 extends outwards until being pressed against an outer sidewall of the lifting container 5 or returning to an initial state.

Similarly, when the lifting container 5 continues to ascend and the buffering pressure rollers 7 squeeze a piston rod of the buffering hydraulic cylinder 14-3, the hydraulic oil of the buffering hydraulic cylinder 14-3 flows out, the hydraulic oil flows into the buffering hydraulic cylinder 14-2, and the piston rod of the buffering hydraulic cylinder 14-2 extends outwards until being pressed against the outer sidewall of the lifting container 5 or returning to an initial state.

By parity of reasoning, the piston rods of the buffering hydraulic cylinders below current positions of the buffering pressure rollers 7 may all extend outwards until being pressed against the outer sidewall of the lifting container 5 or returning to initial positions after the piston rods of the buffering hydraulic cylinders above retract.

Wherein, the hydraulic pump 26 and the energy accumulator 28 are used for keeping the preset pressure of the hydraulic pipeline in the hydraulic system to enable the hydraulic oil to smoothly flow back to the buffering hydraulic cylinders.

Figure 7:
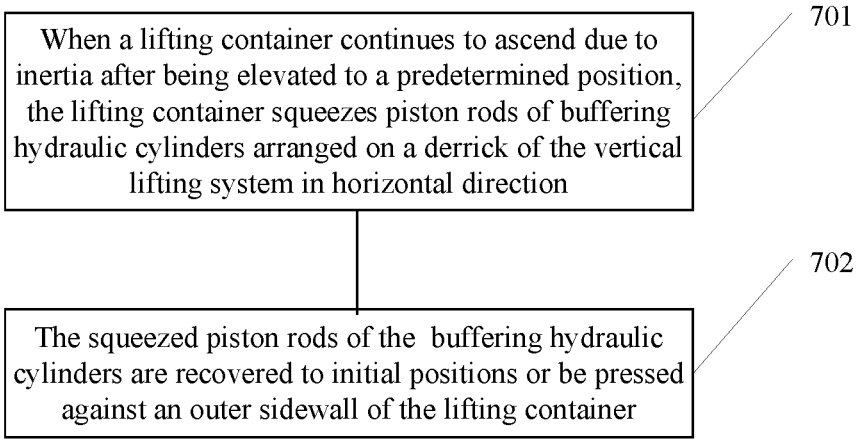
FIG. 7 is a flowchart of an over-winding buffering method for a vertical lifting system according to an embodiment of the disclosure.

The embodiments of the disclosure further provide an over-winding buffering method for a vertical lifting system. FIG. 7 is a flowchart of an over-winding buffering method for a vertical lifting system according to an embodiment of the disclosure. The method includes the following steps.

In Step 701, when a lifting container continues to ascend due to inertia after being elevated to a predetermined position, the lifting container squeezes piston rods of buffering hydraulic cylinders arranged on a derrick of the vertical lifting system from a horizontal direction.

The vertical lifting system includes the derrick and the lifting container, the derrick includes four support posts, and the lifting container may vertically ascend up and down in a space enclosed by the four support posts of the derrick under an action of the vertical lifting system.

The buffering hydraulic cylinders are arranged on the derrick of the vertical lifting system, and the piston rods of the buffering hydraulic cylinders are horizontally arranged.

When the lifting container continues to ascend due to inertia after being elevated to the predetermined position, the lifting container squeezes the piston rods of the buffering hydraulic cylinders arranged on the derrick of the vertical lifting system from a horizontal direction.

Specifically, buffering pressure rollers are arranged on an outer sidewall of the lifting container, and in an ascending process of the lifting container, the buffering pressure rollers may squeeze the piston rods of the buffering hydraulic cylinders from the horizontal direction. Therefore, pressure of the buffering hydraulic cylinders is required to be overcome, upward kinetic energy of the lifting container is consumed, and ascending of the lifting container is cushioned.

In Step 702, the squeezed piston rods of the buffering hydraulic cylinders are recovered to initial positions or be pressed against an outer sidewall of the lifting container.

Therefore, in the ascending or descending process of the lifting container, a frictional braking effect is achieved between the buffering hydraulic cylinders and the lifting container.

Specifically, the operation that the squeezed piston rods of the buffering hydraulic cylinders are recovered to the initial positions or be pressed against the outer sidewall of the lifting container includes two solutions.

A first solution: when the lifting container continues to ascend due to inertia and when the buffering pressure rollers fixed on the outer sidewall of the lifting container leave outer end faces of the piston rods of the buffering hydraulic cylinders at current positions, the piston rods of the buffering hydraulic cylinders at the current positions are recovered to the initial positions or be pressed against the outer sidewall of the lifting container.

Specifically, a principle that the piston rods of the buffering hydraulic cylinders at the current positions are recovered to the initial positions or be pressed against the outer sidewall of the lifting container is that: hydraulic oil at a preset pressure is arranged in a hydraulic pipeline connecting the buffering hydraulic cylinders, the preset pressure being sufficient for the piston rods to extend outwards and overcome certain external pressure, and when upward movement kinetic energy of the lifting container is sufficient, the buffering pressure rollers on the outer sidewall of the lifting container may overcome the preset pressure, the hydraulic oil flows out of the buffering hydraulic cylinders, and the piston rods of the buffering hydraulic cylinders retract; and when the buffering pressure rollers leave the positions of the piston rods of the buffering hydraulic cylinders, the hydraulic oil at the preset pressure may flow back to the buffering hydraulic cylinders, and the piston rods of the buffering hydraulic cylinders may extend outwards again until returning to initial positions or being pressed against the outer sidewall of the lifting container.

A second solution: when the lifting container continues to ascend due to inertia and when the buffering pressure rollers fixed on the outer sidewall of the lifting container squeeze the piston rods of the buffering hydraulic cylinders at the current positions, the piston rods of the buffering hydraulic cylinders below the current positions are recovered to the initial positions or be pressed against the outer sidewall of the lifting container.

Specifically, a principle that the piston rods of the buffering hydraulic cylinders at the current positions are recovered to the initial positions or be pressed against the outer sidewall of the lifting container is that: after the piston rods of the buffering hydraulic cylinders at the current positions are squeezed by the buffering pressure rollers, the hydraulic oil flows out of the buffering hydraulic cylinders at the current positions; and since the hydraulic oil at the preset pressure is arranged in the whole hydraulic pipeline and the piston rods of the buffering hydraulic cylinders below the current positions are in a free state, that is, pressure in the buffering hydraulic cylinders below the current positions is lowest, the hydraulic oil flowing out of the buffering hydraulic cylinders at the current positions drives the hydraulic oil in the pipeline to flow into the buffering hydraulic cylinders below the current positions.

Of course, the two solutions may be superposed, so that a braking action achieved by the buffering hydraulic cylinders is stronger.

Furthermore, before the buffering hydraulic cylinders work, the hydraulic oil at the preset pressure is provided in the hydraulic pipeline connecting the buffering hydraulic cylinders. Therefore, the result that the squeezed piston rods of the buffering hydraulic cylinders are recovered to the initial positions or be pressed against the outer sidewall of the lifting container may be achieved. Moreover, the two solutions are applicable.

Specifically, the hydraulic oil at the preset pressure may be provided in the hydraulic pipeline connecting the buffering hydraulic cylinders through equipment such as a hydraulic pump and an energy accumulator, so that the piston rods of the buffering hydraulic cylinders may extend outwards to predetermined positions. Meanwhile, overflow valves at the preset pressure are mounted in the pipeline between the buffering hydraulic cylinders and the oil tank, and only when external forces on the piston rods of the buffering hydraulic cylinders are higher than the preset pressure of the overflow valves, the piston rods of the buffering hydraulic cylinders may retract.

The above is only the preferred embodiment of the disclosure and not intended to limit the scope of protection of the disclosure. Any modifications, equivalent replacements, improvements and the like made within the spirit and principle of the disclosure shall fall within the scope of protection of the disclosure.

INDUSTRIAL APPLICABILITY

According to the over-winding buffer and method for the vertical lifting system in the embodiments of the disclosure, friction energy absorption type over-winding buffering is implemented through the hydraulic cylinders, a braking force is gradually strengthened in a buffering process, a braking process of the hydraulic cylinders is convenient to control, the braking force is convenient to regulate, the braking force is strengthened by increasing pressure of the hydraulic pipeline, and the braking force may further be strengthened by increasing a number of the hydraulic cylinders. Therefore, safety, reliability, fast recovery, simple structure and low cost are achieved.

The invention claimed is:

1. An over-winding buffer device for a vertical lifting system, the vertical lifting system comprising a derrick and a lifting container, wherein the derrick is provided with a hydraulic buffer which comprises one or more buffering hydraulic cylinders and buffering pressure rollers corresponding to the buffering hydraulic cylinders;

each of the buffering hydraulic cylinders is mounted on the derrick, and has a piston rod which is horizontally arranged, and an outer end of the piston rod is oriented towards the lifting container; each of the buffering pressure rollers is horizontally fixed on an outer sidewall of the lifting container, and has an arc surface which is oriented towards the piston rod of the corresponding buffering hydraulic cylinder.

2. The over-winding buffer device for the vertical lifting system according to claim 1, wherein the one or more buffering hydraulic cylinders are uniformly arranged on the derrick from bottom to top, and an outer end face of the piston rod of each of the buffering hydraulic cylinders is aligned in an initial state.

3. The over-winding buffer device for the vertical lifting system according to claim 2, wherein the outer end face of the piston rod of the buffering hydraulic cylinder is provided with replaceable wear-resistant material.

4. The over-winding buffer device for the vertical lifting system according to claim 3, wherein the replaceable wear-resistant material is wear-resistant steel belt; and one end of the wear-resistant steel belt is fixed on the outer end face of the piston rod of a upper buffering hydraulic cylinder of two buffering hydraulic cylinders which are adjacent in a vertical direction, another end of the wear-resistant steel belt is fixed on the outer end face of a lower buffering hydraulic cylinder of the two buffering hydraulic cylinders.

5. The over-winding buffer device for the vertical lifting system according to claim 1, wherein the hydraulic buffer comprises multiple buffering hydraulic cylinders; the derrick comprises four support posts, on each of which respective buffering hydraulic cylinders are arranged; the piston rod of each of the buffering hydraulic cylinders is oriented towards the outer sidewall of the lifting container.

6. The over-winding buffer device for the vertical lifting system according to claim 1, wherein the device is further provided with upright posts and beams, the upright posts are fixed on the derrick, and each of the beams can slide up and down on the upright posts; each of the beams is provided with support claws for supporting the lifting container.

7. The over-winding buffer device for the vertical lifting system according to claim 6, wherein the device is further provided with a metal material plastic deformation buffer, and the metal material plastic deformation buffer comprises buffering metal belts and deformation members; each of the buffering metal belts is fixed on a respective one of the upright posts, and each of the deformation members is fixed on a respective one of the beams; when the lifting container inertially ascends and drives the beams to ascend, each of the buffering metal belts is plastically deformed by a respective one of the deformation members.

8. The over-winding buffer device for the vertical lifting system according to claim 7, wherein the deformation members are deformation pressure roller sets arranged on the beams, each deformation pressure roller set comprises three deformation pressure rollers arranged in the vertical direction, each buffering metal belt has an end fixed at one end of the upright post, and another end fixed at another end of the upright post after passing through the three deformation pressure rollers, and the buffering metal belt passing between the three deformation pressure rollers has an S shape.

9. An over-winding buffering method for a vertical lifting system, the method comprising:

squeezing, by a lifting container, piston rods of buffering hydraulic cylinders arranged on a derrick of the vertical lifting system in a horizontal direction, when the lifting container continues to ascend due to inertia after being elevated to a predetermined position; and recovering the squeezed piston rods of the buffering hydraulic cylinders to initial positions or extending outwards the squeezed piston rods of the buffering hydraulic cylinders to be pressed against the outer sidewall of the lifting container.

10. The method according to claim 9, wherein the recovering the squeezed piston rods of the buffering hydraulic cylinders to the initial positions or extending outwards the squeezed piston rods of the buffering hydraulic cylinders to be pressed against the outer sidewall of the lifting container comprises:

when the lifting container continues to ascend due to inertia and buffering pressure rollers fixed on the outer sidewall of the lifting container leave outer end faces of the piston rods of the buffering hydraulic cylinders at current positions, recovering the piston rods of the buffering hydraulic cylinders at the current positions to the initial positions, or extending outwards the squeezed piston rods of the buffering hydraulic cylinders to be pressed against the outer sidewall of the lifting container.

11. The method according to claim 9, wherein the recovering the squeezed piston rods of the buffering hydraulic cylinders to the initial positions or extending outwards the squeezed piston rods of the buffering hydraulic cylinders to be pressed against the outer sidewall of the lifting container comprises:

recovering the piston rods of the buffering hydraulic cylinders below the current positions to the initial positions when the lifting container continues to ascend due to inertia and the buffering pressure rollers fixed on the outer sidewall of the lifting container squeeze the piston rods of the buffering hydraulic cylinders at the current positions.

12. The method according to claim 9, further comprising:

distributing hydraulic oil at a preset pressure into a hydraulic pipeline connecting the buffering hydraulic cylinders.

13. The over-winding buffer device for the vertical lifting system according to claim 2, wherein the device is further provided with upright posts and beams, the upright posts are fixed on the derrick, and each of the beams can slide up and down on the upright posts; each of the beams is provided with support claws for supporting the lifting container.

14. The over-winding buffer device for the vertical lifting system according to claim 3, wherein the device is further provided with upright posts and beams, the upright posts are fixed on the derrick, and each of the beams can slide up and down on the upright posts; each of the beams is provided with support claws for supporting the lifting container.

15. The over-winding buffer device for the vertical lifting system according to claim 4, wherein the device is further provided with upright posts and beams, the upright posts are fixed on the derrick, and each of the beams can slide up and down on the upright posts; each of the beams is provided with support claws for supporting the lifting container.

16. The over-winding buffer device for the vertical lifting system according to claim 5, wherein the device is further provided with upright posts and beams, the upright posts are fixed on the derrick, and each of the beams can slide up and down on the upright posts; each of the beams is provided with support claws for supporting the lifting container.

17. The method according to claim 10, further comprising:

distributing hydraulic oil at a preset pressure into a hydraulic pipeline connecting the buffering hydraulic cylinders.

18. The method according to claim 11, further comprising:

distributing hydraulic oil at a preset pressure into a hydraulic pipeline connecting the buffering hydraulic cylinders.

* * * * *